US006486848B1

(12) United States Patent
Poilasne et al.

(10) Patent No.: US 6,486,848 B1
(45) Date of Patent: Nov. 26, 2002

(54) CIRCULAR POLARIZATION ANTENNAS AND METHODS

(76) Inventors: Gregory Poilasne, 11411 Ohio Ave., Apt. #10, Los Angeles, CA (US) 90025; Laurent Desclos, 11411 Ohio Ave., Apt. 12, Los Angeles, CA (US) 90025; Sebastian Rowson, 2501 Pico Blvd., Apt. #409, Santa Monica, CA (US) 90405

( * ) Notice: Subject to any disclaimer, the term of this patent is extended or adjusted under 35 U.S.C. 154(b) by 0 days.

(21) Appl. No.: 09/938,792

(22) Filed: Aug. 24, 2001

(51) Int. Cl.[7] ..... H01Q 21/26
(52) U.S. Cl. ..... 343/797; 343/801
(58) Field of Search ..... 343/742, 867, 343/741, 866, 855, 801, 802, 803, 806, 797

(56) References Cited

U.S. PATENT DOCUMENTS 5,592,182 A * 1/1997 Yao et al. ..... 343/742
5,952,982 A * 9/1999 Jorgenson et al. ..... 343/797
6,014,107 A * 1/2000 Wiesenfarth ..... 343/742

* cited by examiner

*Primary Examiner*—Don Wong
*Assistant Examiner*—Hoang Nguyen

(57) ABSTRACT

Antenna systems employing multiple linear polarization antennas that have capacitively loaded magnetic dipoles and that are magnetically coupled to generate a circular polarization. In a first embodiment of the present invention, two intersecting linearly polarized antennas elements are arranged to obtain a circular polarization. In a second embodiment, a first linearly polarization antenna is placed orthogonally to a second linearly polarization antenna where a single active feed excites the first linearly polarization antenna.

24 Claims, 13 Drawing Sheets

CIRCULAR POLARIZATION ANTENNAS AND METHODS

CROSS REFERENCE TO RELATED APPLICATIONS

This application relates to concurrently filed, co-pending application U.S. patent application Ser. No. 09/781,720, filed on Feb. 12, 2001, entitled "Magnetic Dipole Antenna Structure and Method" by Eli Yablonovitch et al., owned by the assignee of this application and incorporated herein by reference.

BACKGROUND INFORMATION

1. Field of the Invention

The present invention relates generally to the field of wireless communication, and particularly to the design of an antenna.

2. Description of Related Art

Small antennas are attractive in portable wireless communication devices. One type of compact antennas uses a circular polarization. A circularly polarized antenna may improve the performance of a mobile system. To produce a resonant antenna structure at a certain radio frequency and within a certain bandwidth with a circular polarization, classical antenna structures need to have a certain volume. This volume is fairly large as the bandwidth required is large, especially as the antenna needs to be symmetrical to meet the circular polarization constraint.

Accordingly, the present invention addresses the needs of small compact circularly polarized antennas with possibly a wide bandwidth that could be integrated in a mobile device.

SUMMARY OF THE INVENTION

The present invention provides an antenna system using capacitively loaded magnetic dipoles, magnetically coupled in order to obtain a circular polarization. In a first embodiment of the present invention, two intersecting linearly polarized antenna elements are arranged to obtain a circular polarization. In a second embodiment, a first linearly polarization antenna is placed orthogonally to a second linearly polarization antenna where a single active feed excites the first linearly polarized element. In terms of lengths, the first linear polarization antenna can have a length that is greater or less than the length of the second linear polarization antenna. On the vertical or z-axis, the first linear polarization antenna can be positioned above, below, or at the same level as the second linear polarization antenna. One or more elements, such as an electronic chip, can be inserted between the first linear polarization antenna and the second linear polarization antenna without disturbing the circular polarization generated from the magnetically coupled first and second linearly polarized antennas. In a third embodiment, a circular polarization antenna structure is constructed with two curved linear polarization antennas. In a fourth embodiment, an antenna system that is able to alternate between right hand circular polarization (RHCP) and left hand circular polarization (LHCP). In a fifth embodiment, an antenna system is configured to tune to a wider frequency band.

Advantageously, the antenna system in the present invention allows for circularly polarized waves while occupying a small volume. The present invention further advantageously provides high isolation and strong frequency selectivity through the use of capacitively loaded magnetic dipoles.

Other structures and methods are disclosed in the detailed description below. This summary does not purport to define the invention. The invention is defined by the claims.

DETAILED DESCRIPTION

The antenna system provided according to the principles of this invention comprises a plurality of antenna elements arranged orthogonally comprising of capacitively loaded magnetic dipoles. The advantages of using capacitively loaded magnetic dipoles are that they offer a high isolation and a strong selectivity for a high K factor, with K as defined using the Wheeler's law:

$$\Delta f/f = K.V/\lambda^3$$

This law relates the relative bandwidth $\Delta f/f$ that represents the frequency bandwidth over the frequency. $\lambda$ is the wavelength. The term V represents the antenna mode volume which is enclosed by the antenna. This volume so far as been a metric and no discussion has been made on the real definition of this volume and the relation to the K factor.

Figure 1:
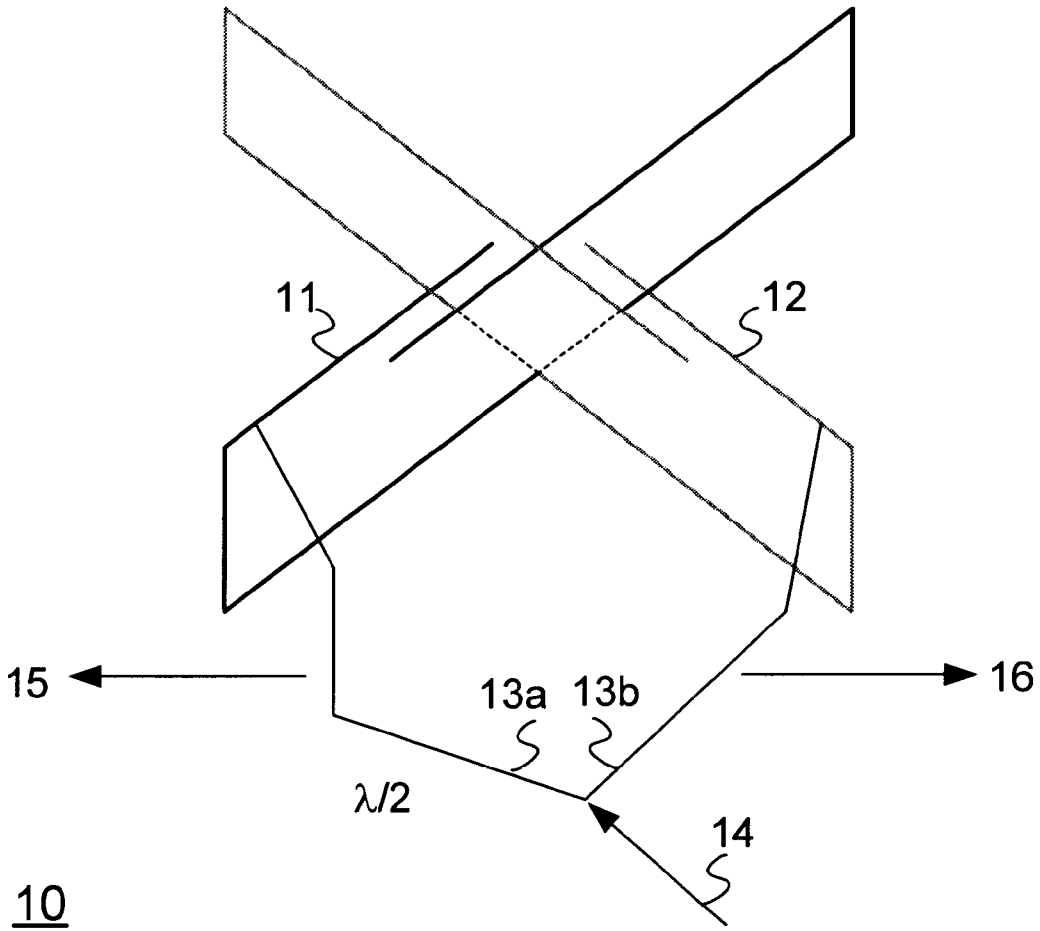
FIG. 1 illustrates a structural diagram of a first embodiment of a circular polarization antenna employing two crossing antennas feed by a 90-degree phase shifter in accordance with the present invention.

FIG. 1 is a structural diagram illustrating the first embodiment of a circular polarized antenna 10 that is comprised of two linearly polarized antennas. A first linearly polarized antenna 11 is connected to a wave-guide as well as a second linearly polarized antenna 12 is connected to another waveguide. The first linearly polarized antenna 11 is positioned orthogonal relative to the second linearly polarized antenna, where the midpoint of the first antenna 11 crosses with the midpoint of the second antenna 12. Although FIG. 1 illustrates the midpoint of the first linearly polarized antenna 11 crossing the midpoint of the second linearly polarized antenna 12, one of ordinary skill in the art should recognize that the first linearly polarized antenna 11 can cross the second linearly polarized antenna 12 at a location other than the midpoint. The feeding system provides a 90-degree phase shift between the first element 11 and the second element 12. A splitter 13 is coupled to the first linearly polarized antenna 11 and the second linearly polarized antenna 12. A single feed 14 is coupled to the splitter. The splitter occupies additional space and may reduce the efficiency of the antenna. The first linearly polarized antenna 11 and the second linearly polarized antenna 12 placed orthogonally relative to one another, where a signal line can excite either the first linearly polarized antenna 11 or the second linearly polarized antenna 12 with a quarter wavelength difference in length. Preferably, only one feeding point is necessary, either a signal feeding into the first linearly polarized antenna 11 or feeding into the second linearly polarized antenna 12 without the use of the splitter 13.

Figure 2:
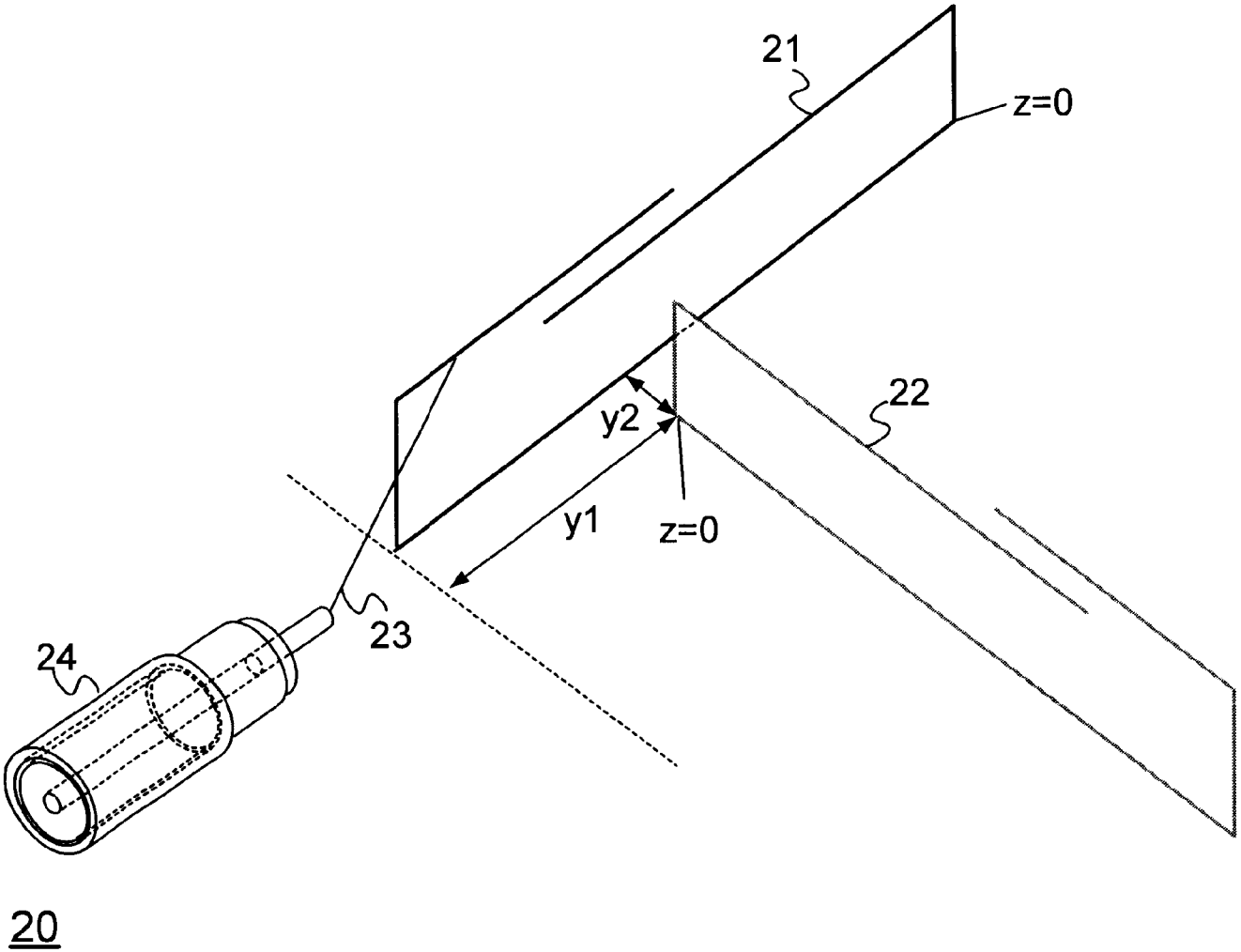
FIG. 2 illustrates a structural diagram of a second embodiment of a circular polarization antenna employing two orthogonal antennas with a single feeding point coupled to a coaxial cable in accordance with the present invention.

FIG. 2 is a structural diagram illustrating a second embodiment of a circular polarized antenna 20 comprising of a first linearly polarized antenna 21 coupled to a single feed 23 coupled to a coaxial cable and a plurality of optimized distances to get a minimized axial ratio. The feed 23 is coupled to an inner conductor of a coaxial cable 24. A second antenna element 22 is positioned perpendicular to the first antenna element 21, where both the second antenna element 22 and the first antenna element 21 are on the same z-plane. In this example, the bottom of the first antenna element 21 sits at z=0, while the second antenna element 22 also sits at z=0. It is apparent to one of ordinary skill in the art that the first antenna element 21 and the second antenna element 22 can also be positioned on positive z-axis or on negative z-axis. The first antenna element 21 does not cross with the second antenna element 22 symmetrically in order to avoid the cancellation of magnetic coupling. The first antenna element 21 excites the parasitic second element 22 producing a circularly polarized mode as well as a linearly polarized mode.

The merger of the linearly polarized and circularly polarized mode can be accomplished by reducing the interaction between the two elements by increasing the distance between the first element 21 and the second element 22, and moving the passive element 22 farther away from the feeding point 23.

Figure 3:
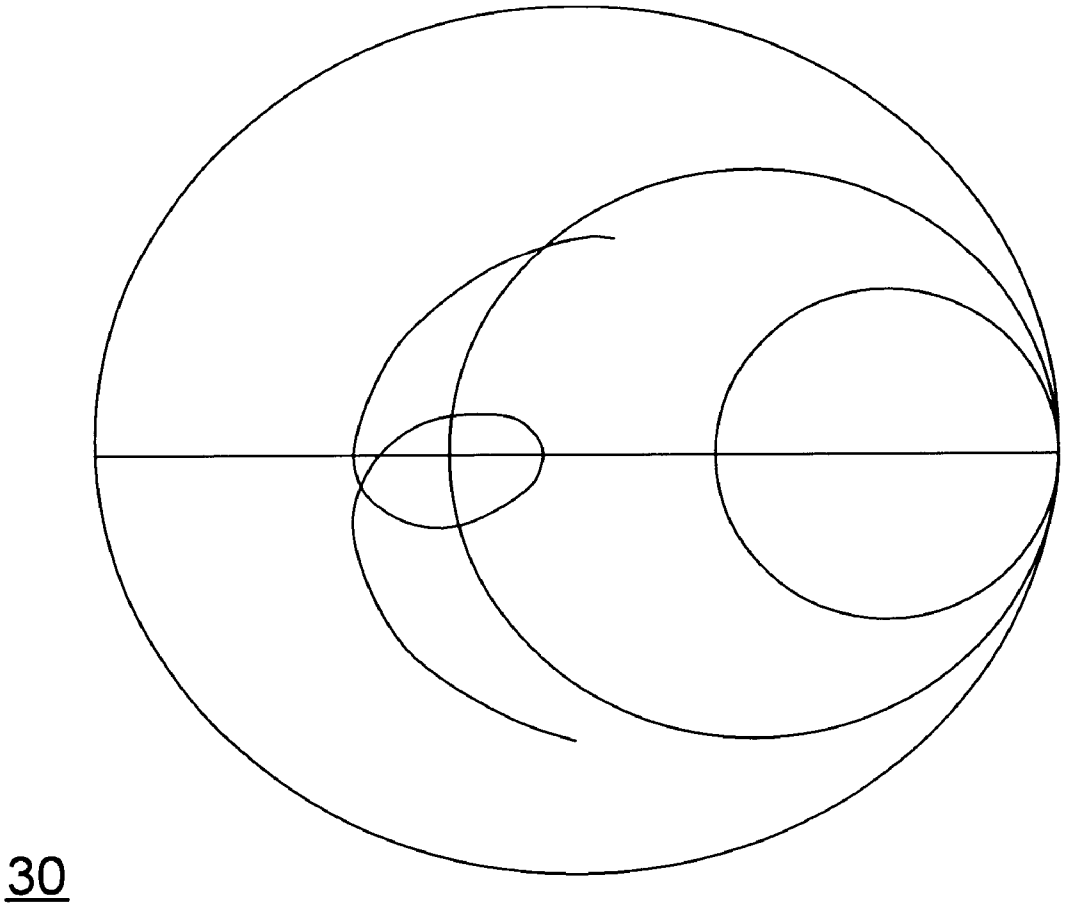
FIG. 3 illustrates a Smith Chart displaying a mode when an antenna is not in an optimized configuration.

FIG. 3 is a Smith Chart showing the results of an antenna that has not been optimized. In that case, the loop in the middle of the Smith chart is quite large. This shows that the two modes have different frequencies. By reducing the coupling between both elements, it is possible to reduce the diameter of the loop and then to gather both modes at the same frequency, so that the circular polarized mode has a high efficiency.

Figure 4:
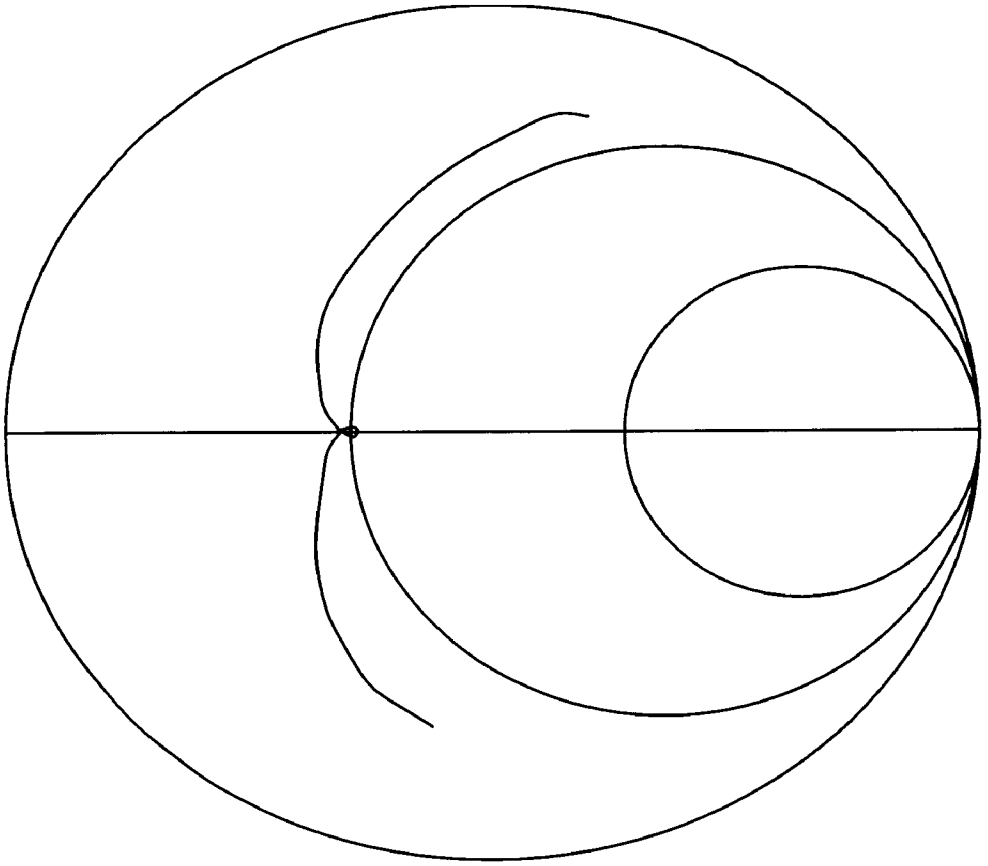
FIG. 4 shows a Smith Chart that of an optimized antenna showing efficient circularly polarized mode in accordance with the present invention.

FIG. 4 shows a Smith Chart 40 that illustrates a reduction in magnetic coupling between a first antenna element and a second antenna element. The smaller loop indicates a reduction in coupling.

Figure 5:
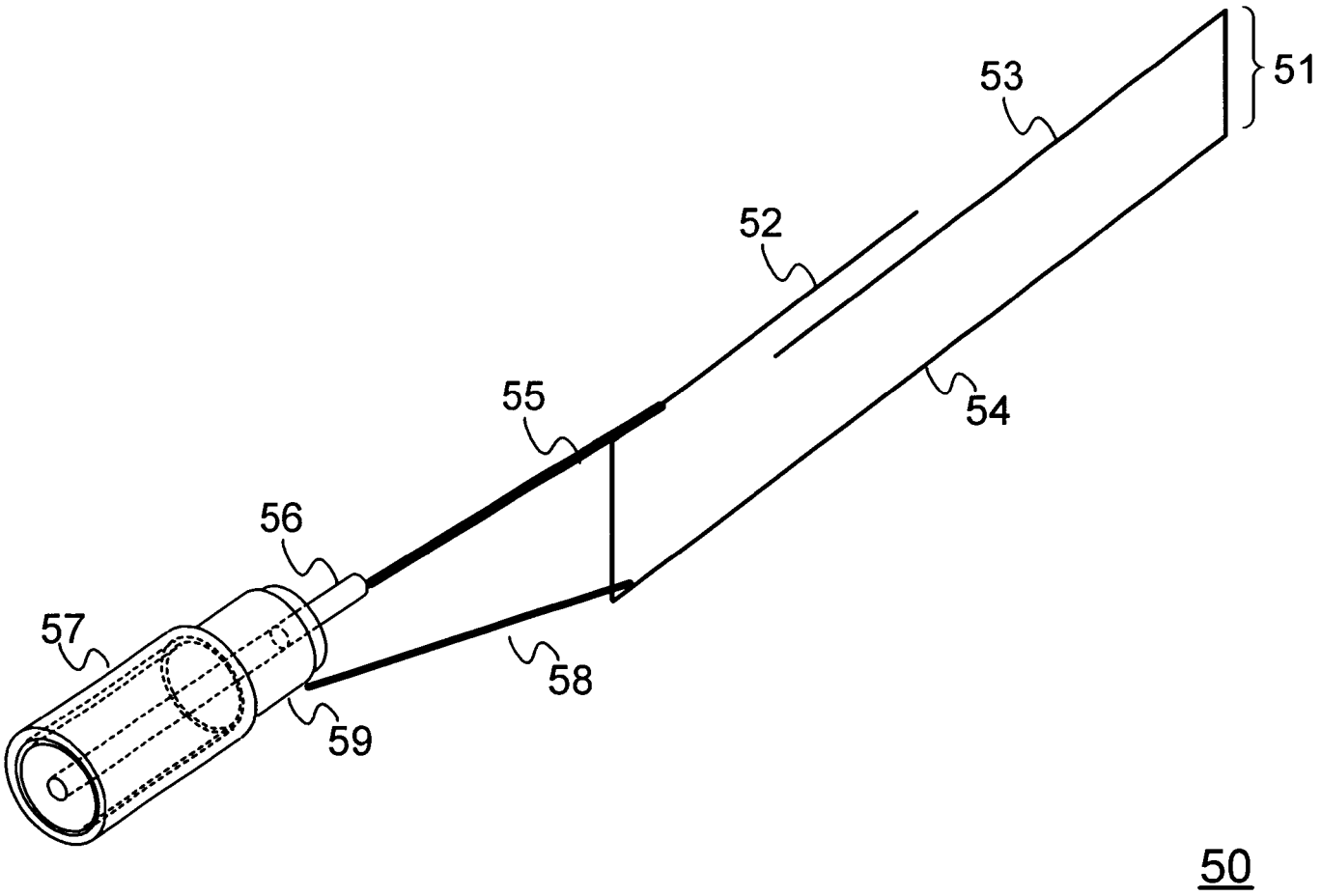
FIG. 5 is a structural diagram illustrating a linearly polarized antenna element connected to a coaxial waveguide that is applicable to the first and second embodiments in accordance with the present invention.

FIG. 5 is a structural diagram illustrating an embodiment of an antenna feed system 50 having an antenna 51 and a coaxial cable 57. The antenna 51 has a top plate 52, a middle plate 53, and a bottom plate 54. The antenna 51 is coupled to a first point 55 and a second point 58, where the first point 55 is coupled to a center conductor 56 of a coaxial waveguide 57, and a second feed 58 is coupled to an outer conductor 59 of a coaxial waveguide 57.

Figure 6:
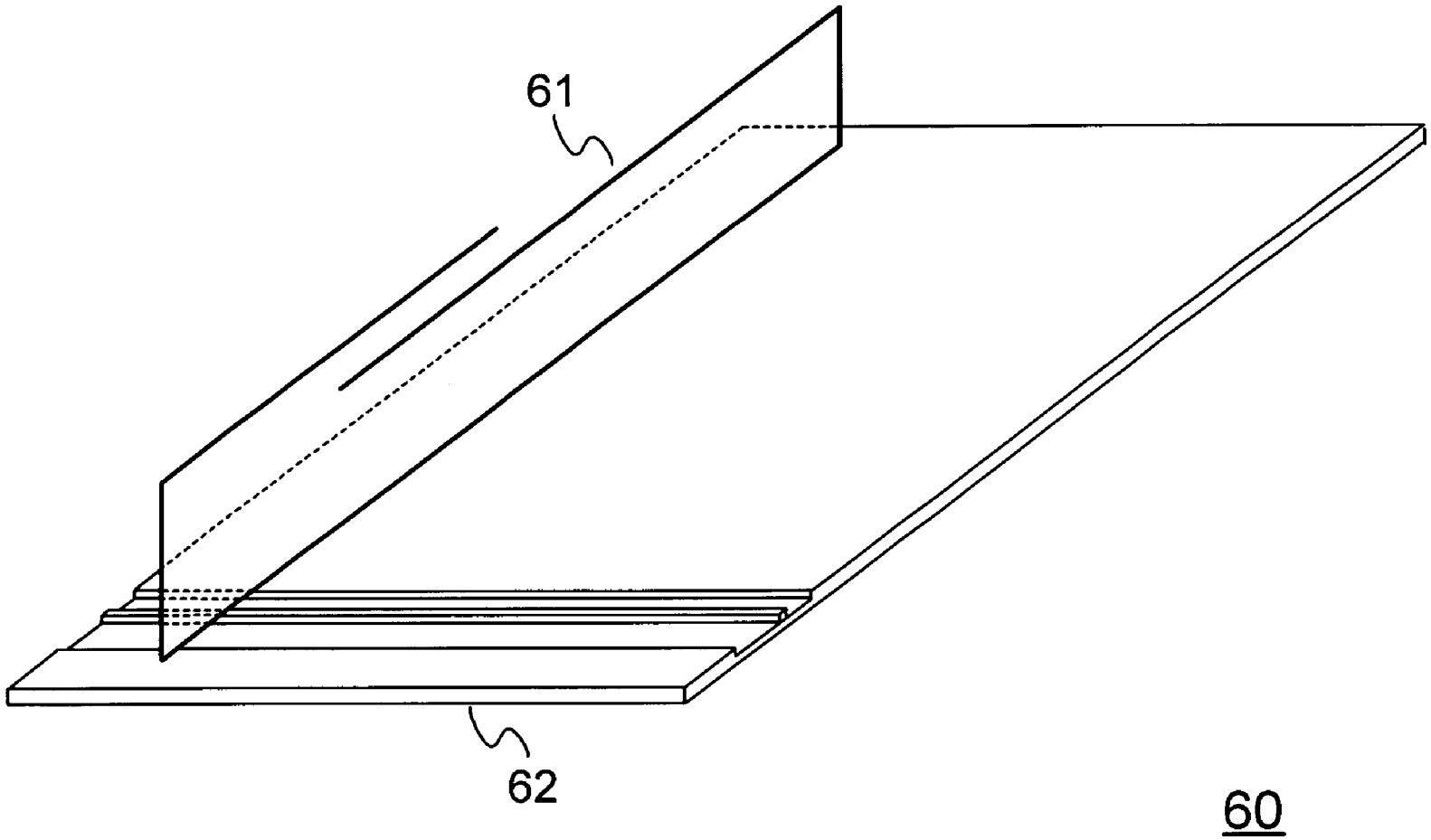
FIG. 6 is a structural diagram illustrating a linearly polarized antenna with a coplanar feeding structure that is applicable to the first and second embodiments in accordance with the present invention.

FIG. 6 is a structural diagram illustrating an embodiment of an antenna feed system 60. An antenna element 61 is placed on a micro-strip or a coplanar waveguide 62. Additional antenna elements can be added for placement on the coplanar waveguide 62.

Figure 7:
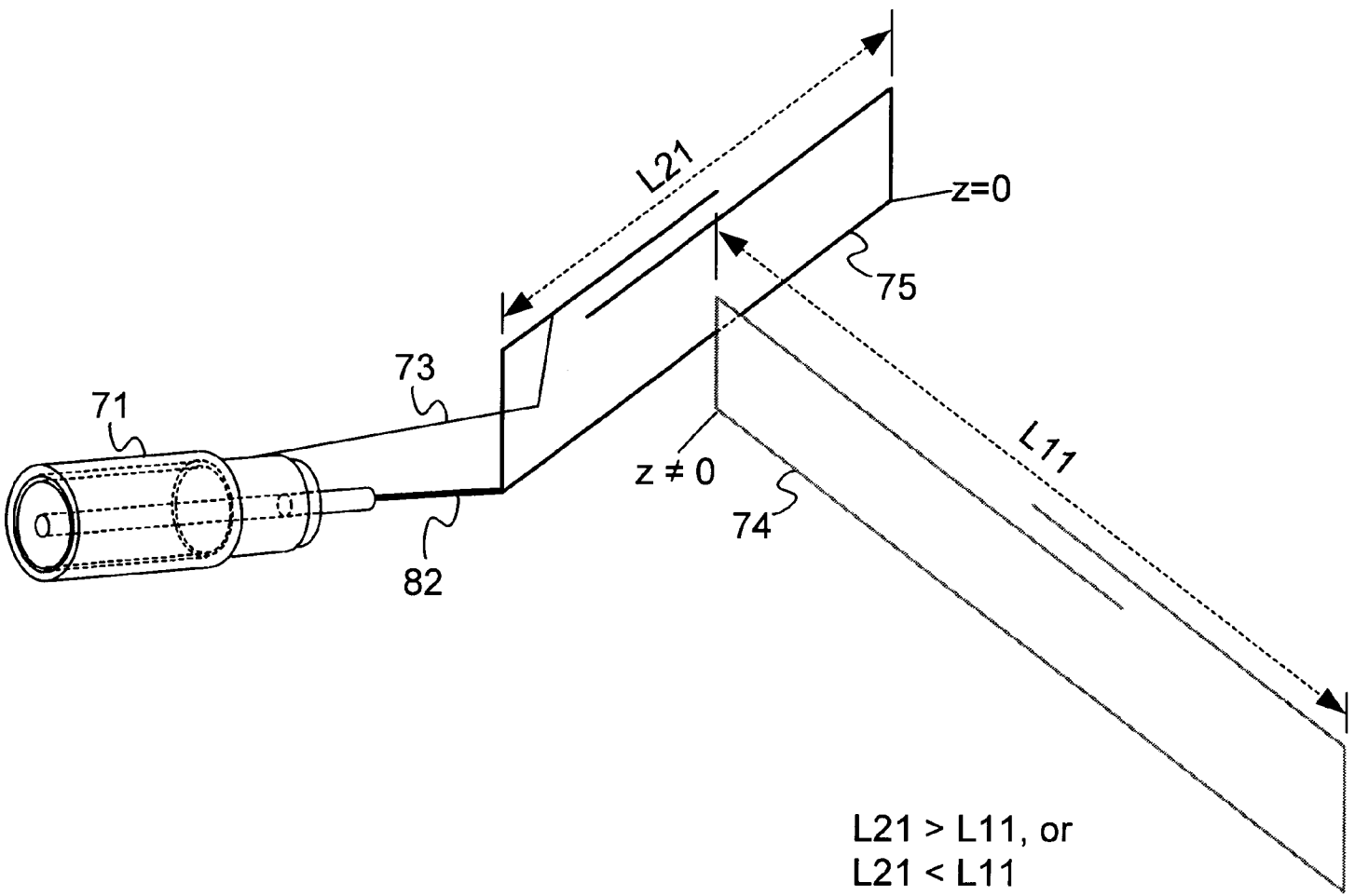
FIG. 7 is a structural diagram illustrating a circular polarization antenna employing two antennas having different lengths applicable to the second embodiment in accordance with the present invention.

FIG. 7 shows a structural diagram illustrating an antenna system 70 with antenna elements of unequal dimensions. A first antenna element 74 having a length $L_1$ is positioned perpendicular to a second antenna element 75 having a length $L_2$, where the length of $L_2$ is greater than the length of $L_1$, or represented in mathematical form, $L_1<L_2$. Alternatively, the length $L_1$ in the first antenna element 74 can be selected to be less than the length $L_2$, or $L_1>L_2$. A further variation of the antenna system 70 is to select the length $L_1$ equal to the length of $L_2$, or $L_1=L_2$. In this example, the bottom of the first antenna element 74 sits at z=0 position, while the bottom of the second antenna element 75 sits at $z\neq0$ position, which means that the second antenna element 75 is positioned on positive z-axis or on negative z-axis.

Figure 8:
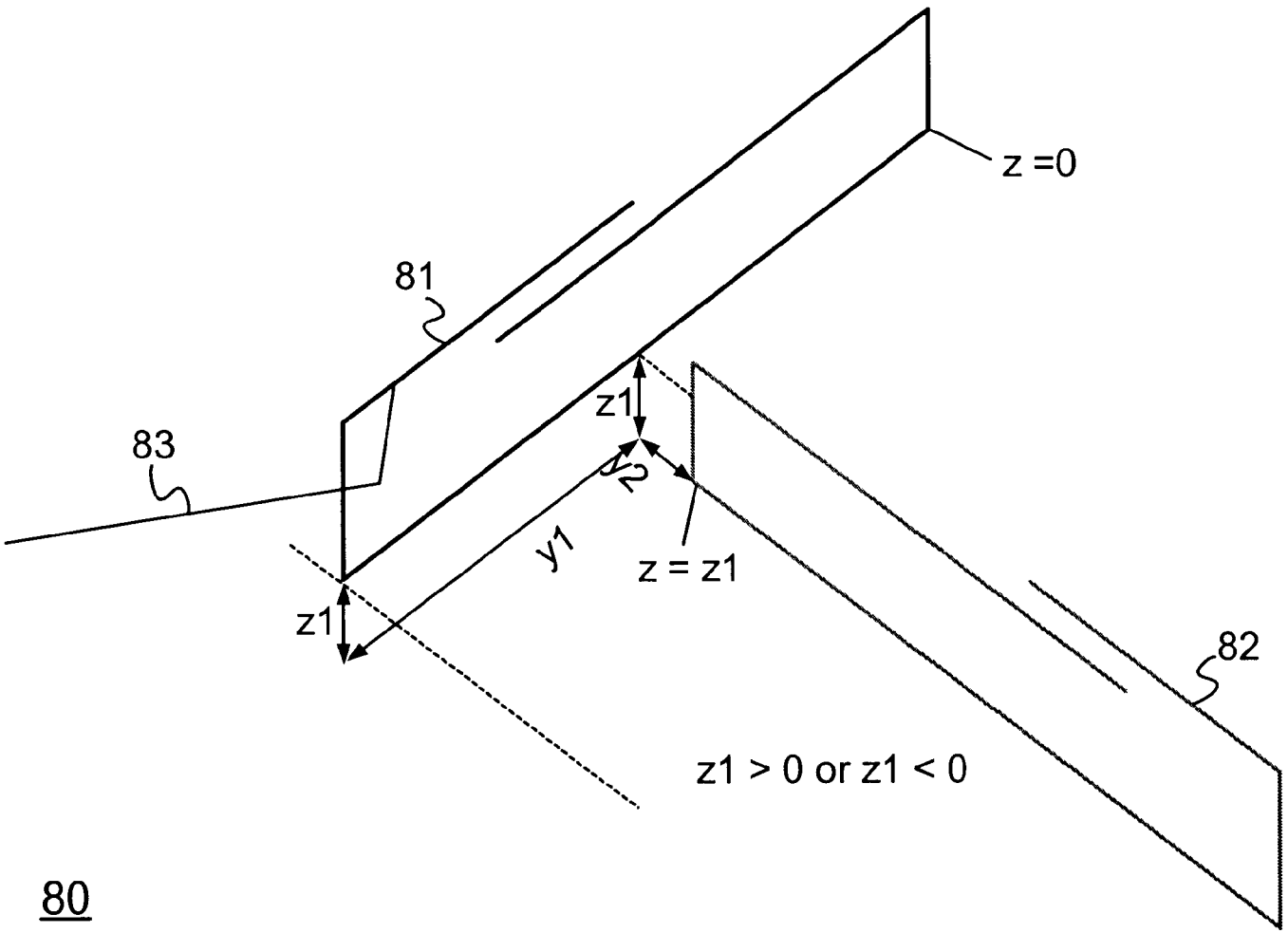
FIG. 8 is a structural diagram illustrating a circular polarization antenna employing two antennas that are placed at different vertical location on z-axis applicable to the second embodiment in accordance with the present invention.

FIG. 8 shows a structural diagram illustrating an antenna system configuration 80. A first element 81 is coupled to a feed 83. In this example, a second element 82 is positioned at a lower level than the first element 81. More specifically, the first antenna element 81 sits at z=0 position, while the second antenna element 82 sits at z=z1 position, where z1 represents a negative z-axis, or z<0. One of ordinary skill in the art should recognize that z1 can be selected to be on positive z-axis, or z>0. The level difference is smaller than the height of the element placed in the lower position. This configuration is used when there is a need for a particular volume to be achieved by the antenna.

Figure 9:
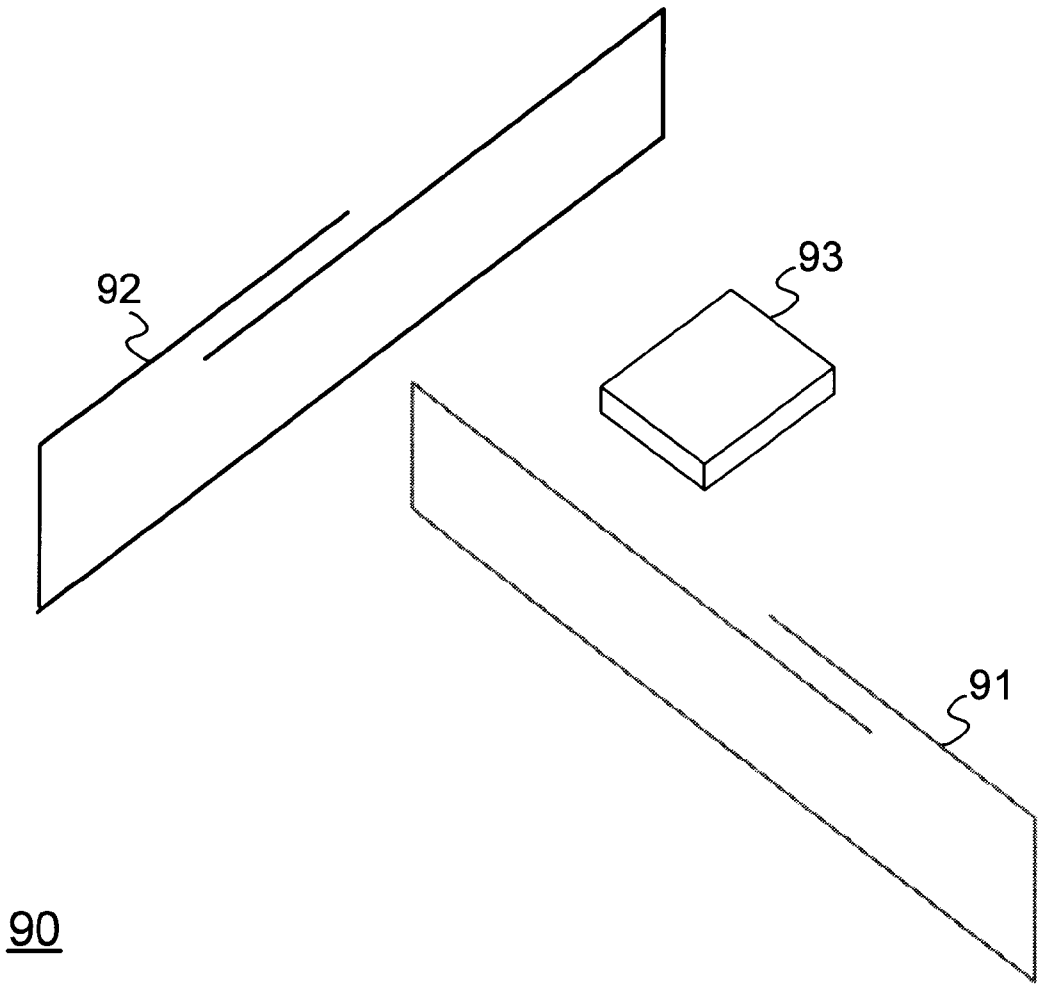
FIG. 9 is a structural diagram illustrating a circular polarization antenna showing inclusion of one or more elements within the circular polarization antenna structure in accordance with the present invention.

FIG. 9 shows a structural diagram illustrating an antenna system configuration 90. A first antenna element 91 is arranged orthogonal to a second antenna 92. The magnetic coupling between element 91 and element 92 is not disturbed when an external element 93, such a chip or an electronic component, is placed between the first element 91 and the second element 92. The antenna behavior is not changed.

Figure 10:
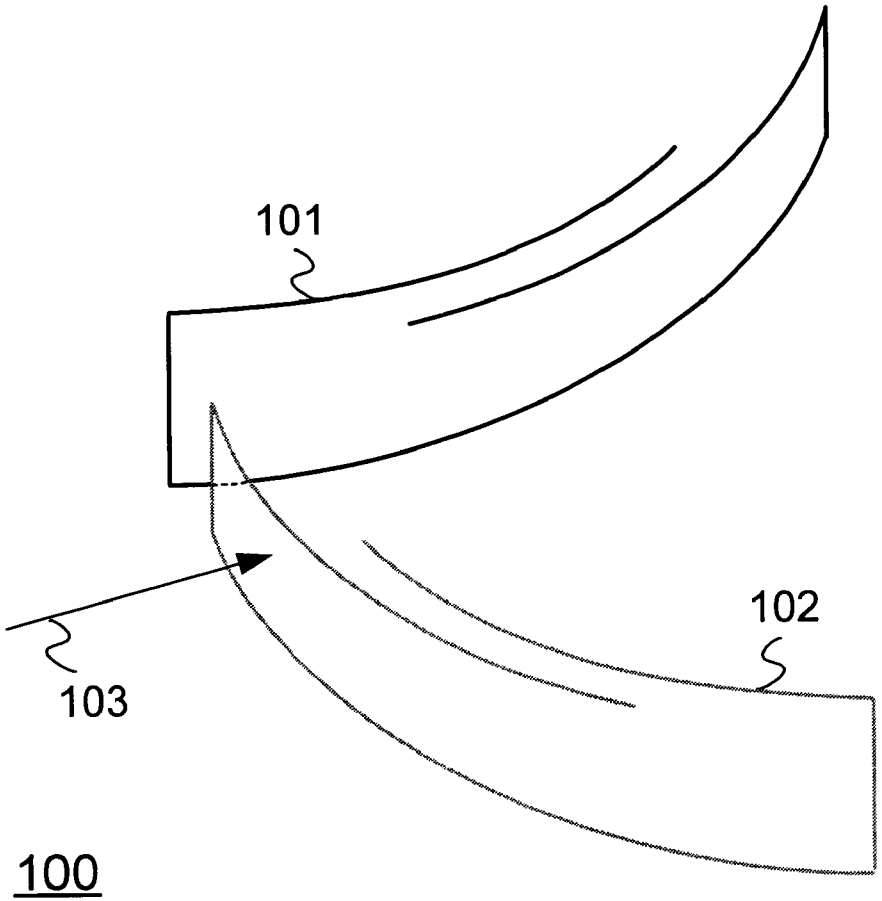
FIG. 10 is a structural diagram illustrating a top view of a third embodiment in a circular polarization antenna employing two antennas with circular shape in accordance with the present invention.

FIG. 10 is a diagram showing the top view of an antenna arrangement 100. A first antenna element has been changed to a curved form 101. A second antenna element of a curved form 102 is placed orthogonally in relation to the first curved antenna element 101. Different shapes of the elementary radiating parts can be employed just as long as they are placed orthogonally from each other. Although curved antennas are shown in this embodiment, other geometric shapes are possible for implementing the present invention, such as circular, square, and s-type curve. Furthermore, the length of the curved antenna 101 can be of the same or different length than the curve antenna 102.

Figure 11:
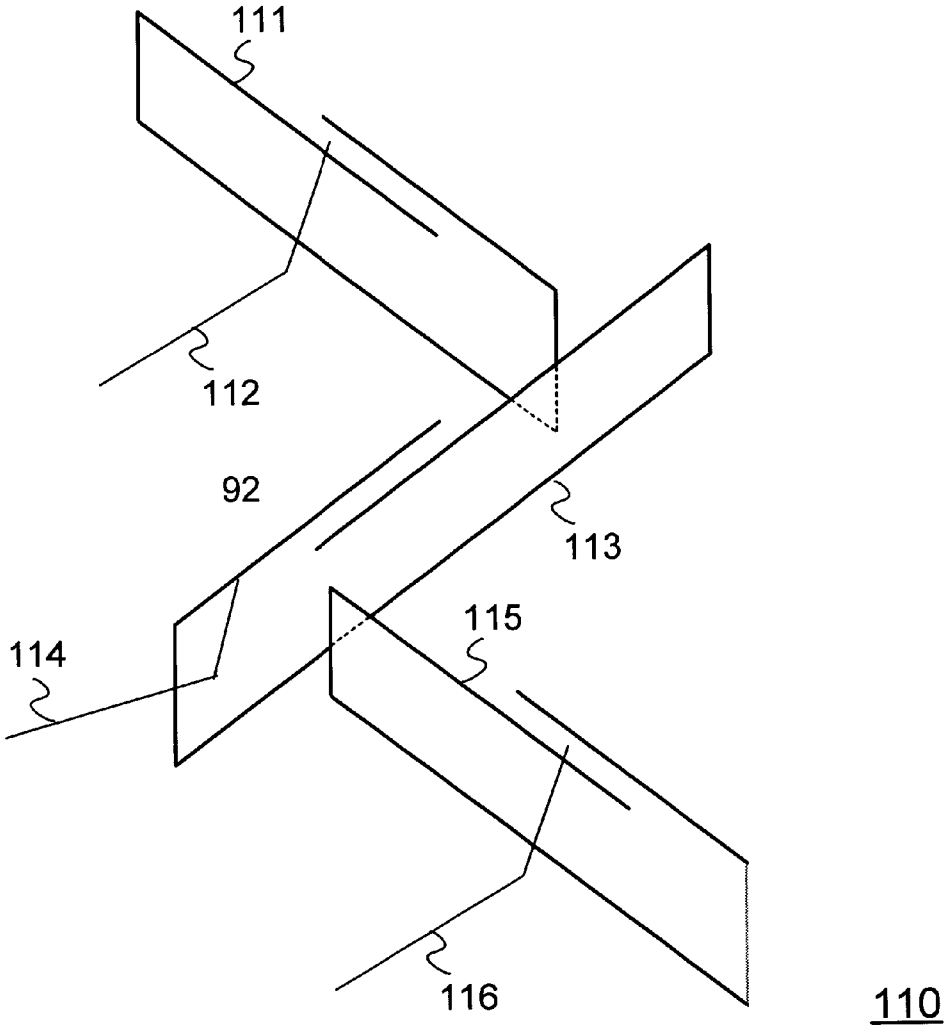
FIG. 11 shows a structural diagram illustrating a fourth embodiment enabling a diversity structure using switching elements in accordance with the present invention.

FIG. 11 shows a structural diagram that utilizes three antenna elements 110. A central antenna element 113 is coupled to a feed 114. A parasitic antenna element 111 is placed perpendicular to one side of the feed antenna element 114. A control element 112 is coupled to the passive antenna element 111. A parasitic antenna element 115 is placed orthogonally with respect to the feed antenna element 113 on the opposite side of the parasitic antenna element 111. Attached to the elements 111 & 115 are control elements respectively 112 & 116. The control element is an active component that switches from an open circuit to a short circuit; the first element is alternate of the second element. Depending on which side the parasitic element is not short-circuited, it is possible to control between left hand circular polarization (LHCP) and right hand circular polarization (RHCP).

Figure 12A:
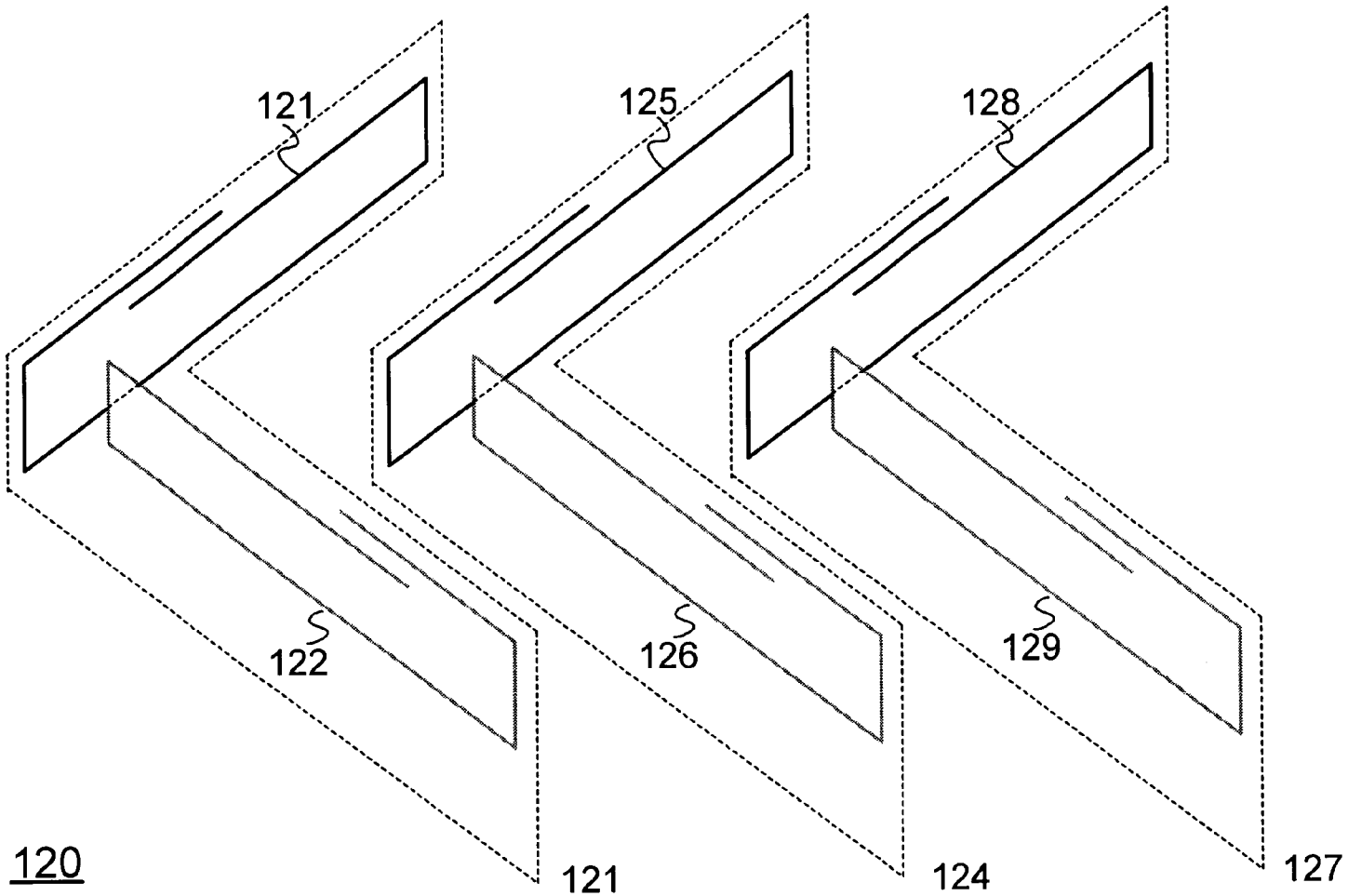
FIG. 12A is a structural diagram illustrating a fifth embodiment showing an antenna configuration for a multi-frequency solution in accordance with the present invention.
Figure 12B:
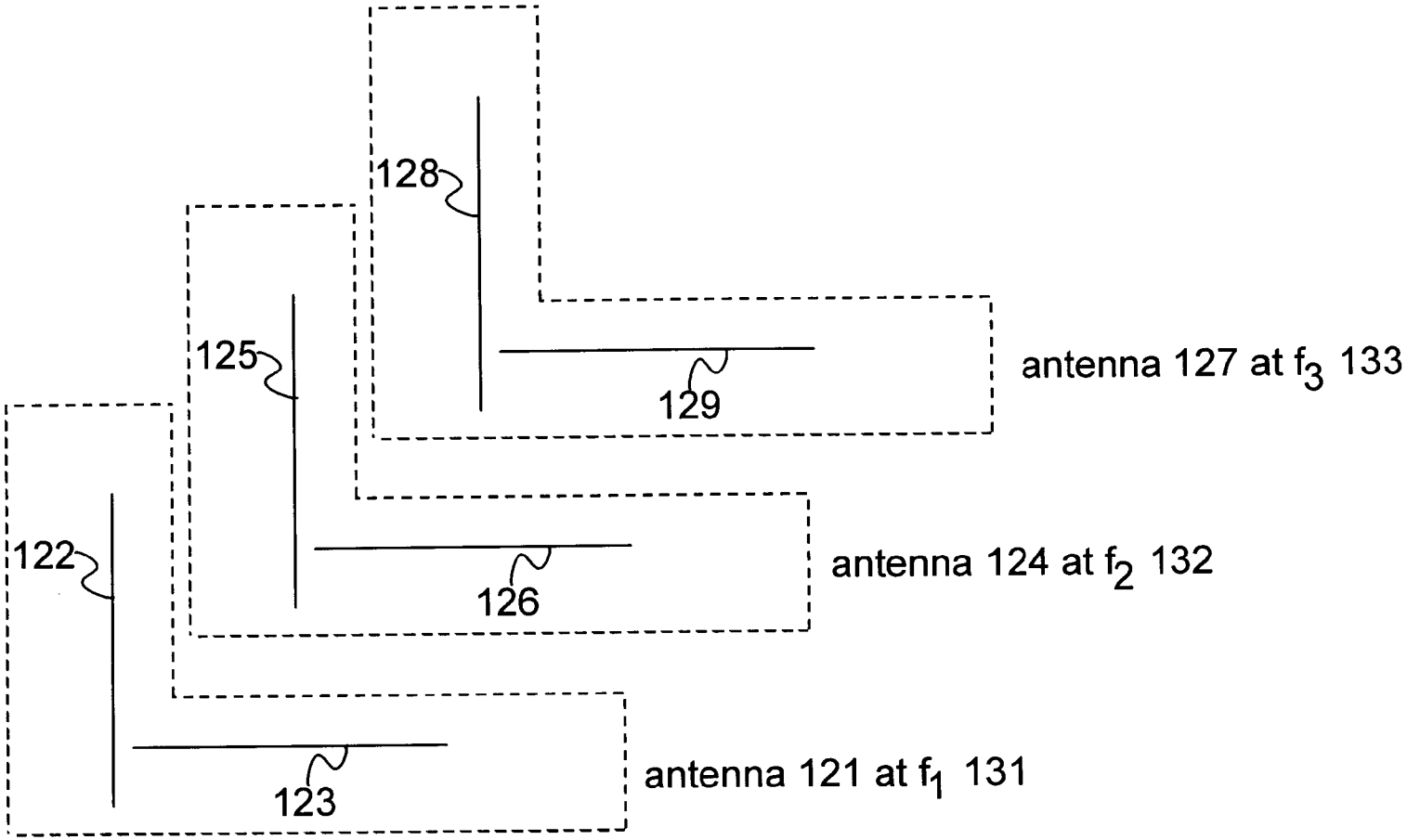
FIG. 12B is a structural diagram exhibiting a top view of the fifth embodiment of a multi-mode solution in accordance with the present invention.

FIG. 12A illustrates an antenna configuration for a multi-mode solution having multiple set of circular polarized antennas, and FIG. 12B illustrates a top view of the multi-frequency arrangement as described in FIG. 12A. A first set of antenna 121 has a first antenna 122 positioned orthogonal to a second antenna 123 in producing a first circular polarization at a first frequency $f_1$ 131. A second set of antenna 124 has a third antenna 125 positioned orthogonal to a fourth antenna 126 in producing a second circular polarization at a second frequency $f_2$ 132. A third set of antenna 127 has a fifth antenna 128 positioned orthogonal to a sixth antenna 129 in producing a third circular polarization at a third frequency $f_3$ 133. Arranging the antenna elements with nearby frequencies in such a fashion increases the bandwidth that can be tuned by the circularly polarized antenna.

The foregoing descriptions of specific embodiments of the invention have been presented for purposes of illustration and description. They are not intended to be exhaustive or to limit the invention to the precise forms disclosed. Obviously, many modifications and variations are possible in light of the above teaching. The embodiments were chosen and described in order to explain the principles and the application of the invention, thereby enabling others skilled in the art to utilize the invention in its various embodiments and modifications according to the particular purpose contemplated. The scope of the invention is intended to be defined by the claims appended hereto and their equivalents.

We claim:

1. A circular polarized antenna system, comprising:

a first linearly polarized antenna creating a first magnetic field in a first direction, a signal being applied to the first linearly polarized antenna; and a second linearly polarized antenna creating a second magnetic field in a second orthogonal direction, crossing with the first linearly polarized antenna, the two linearly polarized antennas being feed with a 90 degree phase shift, wherein the first linearly polarized antenna and the second linearly polarized antenna are capacitively loaded magnetic dipoles.

2. The circular polarized antenna system of claim 1, wherein a midpoint of the first linearly polarized antenna intersects with a midpoint of the second linearly polarized antenna.

3. The circular polarized antenna system of claim 2, further comprising a splitter having an input, a first output, and a second output, wherein the signal feeds to the input of the splitter, the first output coupled to the first linearly polarized antenna, the second output coupled to the second linearly polarized antenna.

4. The circular polarized antenna system of claim 1, wherein the first linearly polarized antenna and the second linearly polarized antenna having a 90-degree phase shift.

5. A circular polarized antenna system, comprising:

a first linearly polarized antenna creating a first magnetic field in a first direction, a signal being applied to the first linearly polarized antenna;

a second linearly polarized antenna creating a second magnetic field in a second orthogonal direction, crossing with the first linearly polarized antenna, the two linearly polarized antenna being feed with a 90 degree phase shift; and micro-strip coplanar waveguide, wherein the first linearly polarized antenna intersects with the second linearly polarized antenna on the micro-strip coplanar waveguide.

6. A circular polarized antenna system, comprising:

a first linearly polarized antenna creating a first magnetic field in a first direction, a signal being applied to the first linearly polarized antenna; and a second linearly polarized antenna positioned orthogonally relative to the first linearly polarized antenna, the second linearly polarized antenna being magnetically coupled to the first linearly polarized antenna, the second linearly polarized antenna creating a second magnetic field in a second orthogonal direction, the combination of the first magnetic field and the second magnetic field resulting in a circular polarization, wherein the first linearly polarized antenna and the second linearly polarized antenna are capacitively loaded magnetic dipoles.

7. The circular polarized antenna system of claim 6, further comprising a feed having a first end coupled to the first linearly polarized antenna.

8. The circular polarized antenna system of claim 7, wherein the feed having a second end coupled to a coaxial cable.

9. The circular polarized antenna system of claim 6, further comprising a micro-strip coplanar waveguide, the second polarized antenna positioned orthogonally relative to the first linearly polarized antenna on the micro-strip coplanar waveguide.

10. The circular polarized antenna system of claim 6, wherein the first linearly polarized antenna having a first length, and wherein the second linearly polarized antenna having a second length.

11. The circular polarized antenna system of claim 10, wherein the first length of the first linearly polarized antenna is equal to the second length of the second linearly polarized antenna.

12. The circular polarized antenna system of claim 10, wherein the first length of the first linearly polarized antenna is greater than the second length of the second linearly polarized antenna.

13. The circular polarized antenna system of claim 10, wherein the first length of the first linearly polarized antenna is less than the second length of the first linearly polarized antenna.

14. The circular polarized antenna system of claim 6, wherein a bottom plate of the first linearly polarized antenna is positioned at a $z_1$ location on z-axis, and wherein a bottom plate of the second linearly polarized antenna is positioned at a $z_2$ location on z-axis.

15. The circular polarized antenna system of claim 14, wherein the $z_1$ location on z-axis of the bottom plate of the first linearly polarized antenna is the same as the $z_2$ location on z-axis of the bottom plate of the second linearly polarized antenna.

16. A circular polarized antenna system, comprising:

a first linearly polarized antenna creating a first magnetic field in a first direction, a signal being applied to the first linearly polarized antenna;

a second linearly polarized antenna positioned orthogonally relative to the first linearly polarized antenna, the second linearly polarized antenna being magnetically coupled to the first linearly polarized antenna, the second linearly polarized antenna creating a second magnetic field in a second orthogonal direction, the combination of the first magnetic field and the second magnetic field resulting in a circular polarization; and a first feed having a first end coupled to a top plate and a second end coupled to a center conductor of a coaxial waveguide.

17. A circular polarized antenna system, comprising:

a first linearly polarized antenna creating a first magnetic field in a first direction, a signal being applied to the first linearly polarized antenna;

a second linearly polarized antenna positioned orthogonally relative to the first linearly polarized antenna, the first linearly polarized antenna being magnetically coupled to the second linearly polarized antenna, the second linearly polarized antenna creating a second magnetic field in a second orthogonal direction, the combination of the first magnetic field and the second magnetic field resulting in a circular polarization; and a second feed having a first end coupled to a bottom plate, and a second end coupled to an outer conductor of the coaxial waveguide.

18. A circular polarized antenna system, comprising:

a first linearly polarized antenna creating a first magnetic field in a first direction, a signal being applied to the first linearly polarized antenna;

a second linearly polarized antenna positioned orthogonally relative to the first linearly polarized antenna, the second linearly polarized antenna being magnetically coupled to the first linearly polarized antenna, the second linearly polarized antenna creating a second magnetic field in a second orthogonal direction, the combination of the first magnetic field and the second magnetic field resulting in a circular polarization;

a bottom plate of the first linearly polarized antenna is positioned at a $z_1$ location on z-axis; and a bottom plate of the second linearly polarized antenna is positioned at a $z_2$ location on z-axis, wherein the $z_1$ location on z-axis of the bottom plate of the first linearly polarized antenna is above the $z_2$ location on z-axis of the bottom plate of the second linearly polarized antenna.

19. A circular polarized antenna system, comprising:

a first linearly polarized antenna creating a first magnetic field in a first direction, a signal being applied to the first linearly polarized antenna;

a second linearly polarized antenna positioned orthogonally relative to the first linearly polarized antenna, the second linearly polarized antenna being magnetically coupled to the first linearly polarized antenna, the second linearly polarized antenna creating a second magnetic field in a second orthogonal direction, the combination of the first magnetic field and the second magnetic field resulting in a circular polarization;

a bottom plate of the first linearly polarized antenna is positioned at a $z_1$ location on z-axis; and a bottom plate of the second linearly polarized antenna is positioned at a $z_2$ location on z-axis, wherein the $z_1$ location on z-axis of the bottom plate of the first linearly polarized antenna below the $z_2$ location on z-axis of the bottom plate of the second linearly polarized antenna.

20. A circular polarized antenna system, comprising:

a first linearly polarized antenna creating a first magnetic field in a first direction, a signal being applied to the first linearly polarized antenna;

a second linearly polarized antenna positioned orthogonally relative to the first linearly polarized antenna, the second linearly polarized antenna being magnetically coupled to the first linearly polarized antenna, the second linearly polarized antenna creating a second magnetic field in a second orthogonal direction, the combination of the first magnetic field and the second magnetic field resulting in a circular polarization; and an electronic component being placed between the first linearly polarized antenna and the second linearly polarized antenna, the first linearly polarized antenna and the second linearly polarized antenna not being disturbed by the placement of the electronic component.

21. A circular polarized antenna system, comprising:

a first linearly polarized antenna having a curve shape and creating a first magnetic field in a first direction, a signal being applied to the first linearly polarized antenna; and a second linearly polarized antenna having a curve shape and a second magnetic field in a second direction, the first linearly polarized antenna being magnetically coupled to the second linearly polarized antenna, the combination of the first magnetic field and the second magnetic field resulting in a circular polarization.

22. A circular polarized antenna system, comprising:

a first linearly polarized antenna creating a first magnetic field in a first direction, the first linearly polarized antenna having a first sidewall and a second sidewall, a signal being applied to the first linearly polarized antenna;

a second linearly polarized antenna positioned orthogonally relative to the first side wall of the first linearly polarized antenna, the second linearly polarized antenna being magnetically coupled to the first linearly polarized antenna, the second linearly polarized antenna creating a second magnetic field in a second direction, the combination of the first magnetic field and the second magnetic field resulting in a first circular polarization; and a third linearly polarized antenna positioned orthogonally relative to the second side wall of the first linearly polarized antenna, the third linearly polarized antenna being magnetically coupled to the first linearly polarized antenna, the third linearly polarized antenna creating a third magnetic field in a third direction, the combination of the first magnetic field and the third magnetic field resulting in a second circular polarization.

23. A circular polarized antenna system, comprising:

a first set of antenna having a first antenna positioned orthogonal to a second antenna thereby producing a first circular polarization at a first frequency $f_1$;

a second set of antenna having a third antenna positioned orthogonal to a fourth antenna thereby producing a second circular polarization at a second frequency $f_2$; and a third set of antenna having a fifth antenna positioned orthogonal to a sixth antenna thereby producing a third circular polarization at a third frequency $f_3$.

24. A circular polarized antenna system, comprising:

a first means for creating a first magnetic field in a first direction, a signal being applied to the first means; and a second means positioned orthogonally relative to the first means, the first means being magnetically coupled to the second means, the second means creating a second magnetic field in a second direction, the combination of the first means and the second means resulting in a circular polarization, wherein the first and second means are capacitively loaded magnetic dipoles.

* * * * *